United States Patent [19]

Wulf

[11] Patent Number: 4,703,778

[45] Date of Patent: Nov. 3, 1987

[54] PICKING MECHANISM FOR LOOMS

[75] Inventor: Adolf Wulf, Möhnesee-Hewingen, Fed. Rep. of Germany

[73] Assignee: Gunne Webmaschinenfabrik GmbH & Co. KG, Fed. Rep. of Germany

[21] Appl. No.: 835,902

[22] Filed: Mar. 4, 1986

[30] Foreign Application Priority Data

May 25, 1985 [DE] Fed. Rep. of Germany ..... 3518987

[51] Int. Cl.[4] ..... D03D 47/30

[52] U.S. Cl. ..... 139/435

[58] Field of Search ..... 139/435, 353

[56] References Cited

U.S. PATENT DOCUMENTS 3,853,151 12/1974 Donk et al. ..... 139/435
4,326,565 4/1982 Mullekom ..... 139/435
4,565,266 1/1986 Tsuji ..... 139/435
4,572,246 2/1986 Ghiaro ..... 139/435

FOREIGN PATENT DOCUMENTS 211655 11/1984 Japan ..... 139/435

*Primary Examiner*—Henry S. Jaudon
*Attorney, Agent, or Firm*—Beveridge, DeGrandi & Weilacher

[57] ABSTRACT

A picking mechanism for looms with pivotable blast nozzles. Nozzles in the case of looms having picking mechanisms in which not only is the nozzle body pivotably mounted at the pivot point but simultaneously the blast nozzles in the front region are vertically pivotably mounted on one or more pneumatic cylinders and on the opposite side of the nozzles, compression springs are provided to give the necessary shock absorption, so that the weft lengths pass from the desired blast nozzles into the U-shaped channel.

6 Claims, 3 Drawing Figures

Fig. 1
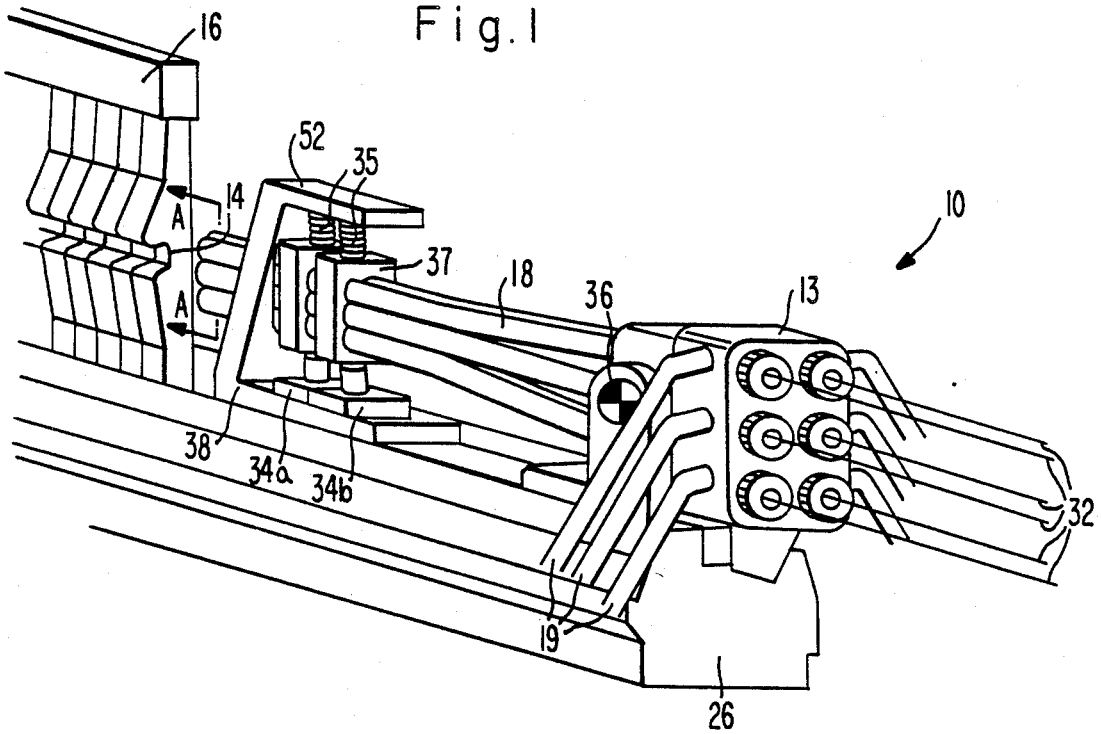
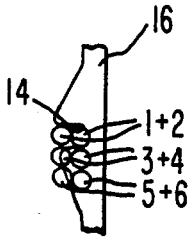
Fig. 1A

PICKING MECHANISM FOR LOOMS

BACKGROUND OF THE INVENTION

The present invention relates to a picking mechanism for looms.

The prior art discloses numerous picking mechanisms and methods for looms. In the case of picking mechanisms operating with fixed blast nozzles, the number of nozzles is relatively limited due to their size and spacing relationships, since all the nozzles must at all times have an effective picking position with respect to the U-shaped channel of the loom reed. In the case of pivotable blast nozzles, their number is also limited since, with an increasing number, the pivoting path becomes longer and the speed of the successive weaving cycles must be increased, even though this speed is already high. This not only increases wear and consequently leads to a greater requirement for maintenance, but also results in inaccurate picking positions.

SUMMARY OF THE INVENTION

The problem of the present invention is to so improve the aforementioned picking mechanism that it ensures a completely satisfactory, non-maintenance-prone operation in the case of four, six, or more blast nozzles, whilst avoiding the aforementioned disadvantages of the prior art.

According to the invention, the aforementioned problem is solved by a picking mechanism having four, six, or more blast nozzles arranged in a paired, closely juxtaposed, horizontal manner upstream of the U-shaped channel or some other air circulation system of the reed so that pivoting or rotation of the nozzle body is unnecessary.

According to the invention, significance is also attached to the fact that the blast nozzles are mounted in the front region on one or more pneumatic cylinders, which can be juxtaposed or successively positioned. As a result of conventional control, they lead to the actual pivoting of the nozzles. On the opposite side is provided a corresponding number of compression springs, providing elasticity or an opposing force, in order to damp undesired vibrations and ensure the precise picking of the desired weft thread.

Further advantages and features can be gathered from the subclaims, which can be of inventive significance either singly or in combination.

BRIEF DESCRIPTION OF THE DRAWING

The invention is described in greater detail hereinafter relative to a non-limitative embodiment and the attached drawings, in which:

FIG. 1 is a perspective diagrammatic view of the picking mechanism according to the invention;

FIG. 1A is an enlarged view taken along line A—A of FIG. 1; and

DETAILED DESCRIPTION OF THE PREFERRED EMBODIMENT

Figure 2:
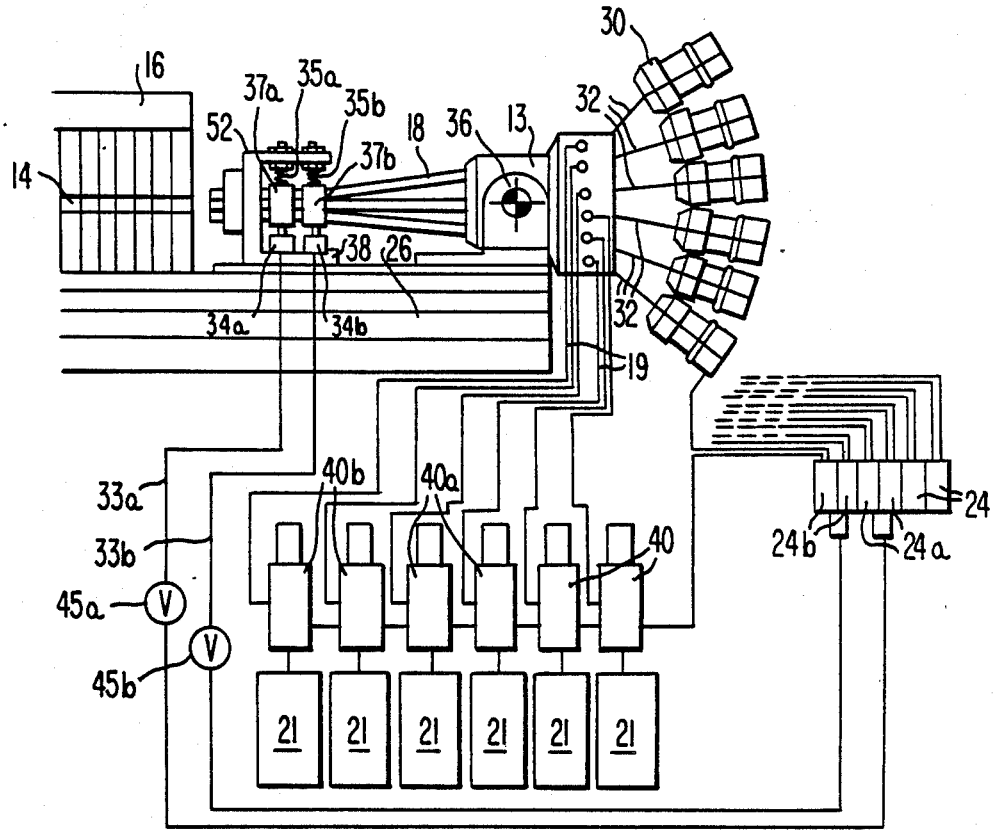
FIG. 2 is diagrammatic representation of the picking mechanism of FIG. 1 with its control system.

FIG. 1 shows the picking mechanism 10 for looms with pivotable blast nozzles. To facilitate the understanding of the drawing, the entire loom is not shown, so that the details according to the invention are more readily apparent. The main or blast nozzles 18 are connected via the nozzle body 13 at the rear end thereof to the sley 26. The vertical pivotability of the blast nozzles 18 takes place about the pivot point 36 of nozzle body 13. Each of the six blast nozzles 18 has its own storage and cutting to length device 30 (FIG. 2). The six weft threads to be picked are designated 32. As depicted in FIG. 2, each of the tubular nozzles 18 has its own compressed air line 19, connected in each case via a corresponding solenoid valve 40 to a corresponding compressed air container 21 to provide compressed air for weft picking. The compressed air is controlled by means of proximity switches 24, 24*a*, and 24*b* fixed to the loom.

Particular significance is attached according to the invention to the mounting support 52, which attaches the front ends of blast nozzles 18 to sley 26. On the base surface 38 of mounting support 52 are successively arranged below blast nozzles 18 two pneumatic cylinders 34*a* and 34*b* which are supplied by compressed air lines 33*a* and 33*b*, respectively. Lines 33*a* and 33*b* include solenoid valves 45*a* and 45*b*, respectively, to control the compresed air in synchronism with the associated solenoid valves 40*a* and 40*b*. Cylinders 34*a* and 34*b* are in contact with two clips 37*a* and 37*b* which hold nozzles 18 as a bundle. Above clips 37*a* and 37*b* are two compression springs 35*a* and 35*b* which oppose the force of pneumatic cylinders 34*a* and 34*b*, since the springs are positioned between clips 37*a* and 37*b* and mounting support 52. Springs 34*a* and 34*b* thus cooperate with pneumatic cylinders 34*a* and 34*b* to retain clips 37*a* and 37*b* in position, with nozzles 18 held by clips 37*a* and 37*b*. The number and arrangement of the pneumatic cylinders 34, clips 37, and compression springs 35 is not critical and can instead be chosen in an appropriate manner. However, it must be ensured that a satisfactory, precise pivoting of the tubular blast nozzles 18 is obtained, so that the weft length 32 from the desired blast nozzles 18 can enter the U-shaped channel 14 of reed 16. This is shown more clearly in the cross-sectional view of FIG. 1A in which the openings 1 and 2 of the top blast nozzles 18 are located in the picking position for the U-shaped channel 14 of reed 16, whilst the central openings 3 and 4 and the lower openings 5 and 6 of blast nozzles 18 are below the picking position and therefore are in the rest position. Only by vertical pivoting of blast nozzles 18 over pivot point 36 by means of pneumatic cylinders 34*a*, 34*b* is it possible for the central or lower nozzles 18, with their openings 3, 4 or 5, 6 to be brought into the desired picking position. To achieve this, solenoid valves 45*a* and 45*b* are operated in synchronism with the associated solenoid valves 40*a* and 40*b*. Thus, when the uppermost nozzles 1 and 2 are to be in the picking position, vertically aligned with channel 14, the two proximity switches 24 actuate the two solenoid valves 40. Neither of the solenoid valves 45*a* and 45*b* is actuated, and so neither of the pneumatic cylinders 34*a* and 34*b* is actuated. Consequently, mounting support 52 is in its lower position with upper nozzles 1 and 2 aligned with channel 14. When the middle nozzles 3 and 4 are to be vertically aligned with channel 14, in the picking position, the two proximity switches 24*a* actuate the two solenoid valves 40*a* and solenoid valve 45*a*. Compressed air then passes through line 33*a* to actuate pneumatic cylinder 34*a*, raising the front ends of nozzles 18 to align the middle nozzles 3 and 4 with channel 14. Likewise, when the lower nozzles 5 and 6 are to be in the picking position, vertically aligned with channel 14, the two proximity switches 24*b* actuate the two solenoid valves 40*b* and solenoid valve 45*b*. Compressed air then passes through line 33*b* to actuate pneumatic cylinder 34*b*, raising the front ends of nozzles 18 to align the lowermost nozzles 5 and 6 with channel 14. Since pivot point 36 permits nozzles 18 to pivot only vertically, the horizontal position of the nozzles is fixed.

In summary the picking mechanism for looms according to the invention in the represented basic position can pick colour and/or grade from the openings 1 and/or 2 of the blast nozzles. On operating pneumatic cylinder 34*a*, the nozzles are brought to the intermediate position in which openings 3 and/or 4 are in the picking position, whilst the operation of pneumatic cylinder 34*b* ensures that the nozzles are brought to their upper position with openings 5, 6 in the desired picking position. It is obvious that the system can be extended to further colours and/or grades. It is also conceivable to only use a single pneumatic cylinder 34, whose stroke can be controlled in different ways.

What is claimed is:

1. A picking mechanism for a loom having a sley and a reed with a channel therein, said picking mechanism comprising:

a plurality of pairs of blast nozzles, each nozzle having a back end terminating in a nozzle body and having a front end terminating in a discharge opening;

first mounting means for pivotally mounting said nozzle body on the sley of a loom with said nozzle front ends pivotal in a vertical direction;

pneumatic drive means;

compression spring means;

second mounting means for mounting said nozzle front ends on the sley of the loom with one of said pairs of said discharge openings substantially aligned with the reed channel, with the nozzles of each pair closely juxtaposed and aligned in horizontal rows, and with the pairs closely juxtaposed in two vertical rows, said second mounting means positioning said nozzle front ends between and substantially aligned with said pneumatic drive means and said compression spring means; and actuating means controlling said pneumatic drive means for moving said nozzle front ends vertically against the force of said compression spring means, thus vertically pivoting said nozzle front ends to move said nozzles between positions vertically aligning each of said pairs of discharge openings with the reed channel, permitting positioning of said pairs of nozzles for discharge of weft threads from the nozzles of the aligned pair into the reed channel.

2. A picking mechanism as claimed in claim 1 wherein said plurality of pairs of blast nozzles comprises three pairs of blast nozzles and wherein said pneumatic drive means is adapted to move said nozzle front ends between a first position in which the uppermost horizontal row of nozzle front ends is aligned with the loom channel, a second position in which the center row of nozzle front ends is aligned with the loom channel, and a third position in which the lowermost row of nozzle front ends is aligned with the loom channel.

3. A picking mechanism as claimed in claim 2 wherein said pneumatic drive means comprises a first pneumatic cylinder actuable to move said nozzle front ends vertically to the second position and a second pneumatic cylinder actuable to move said nozzle front ends vertically to the third position, said compression spring means moving said nozzle front ends vertically to the first position when both said first and said second pneumatic cylinders are not-actuated.

4. A picking mechanism as claimed in claim 3 wherein said compression spring means comprises a first compression spring and a second compression spring and said second mounting means comprises a first mounting clip mounting said nozzle front ends between said first pneumatic cylinder and said first compression spring and a second mounting clip mounting said nozzle front ends between said second pneumatic cylinder and said second compression spring.

5. A picking mechanism as claimed in claim 1 wherein said second mounting means comprises at least one mounting clip.

6. A picking mechanism as claimed in claim 1 further comprising six picking controllers, one picking controller uniquely associated with each separate one of said blast nozzles; each picking controller comprising a solenoid valve, an air inlet for connecting said solenoid valve to an air container, air flow means connecting said solenoid valve to the associated one of said blast nozzles, and a proximity switch adapted for connection to the loom for actuating said solenoid valve in response to operation of the loom.

* * * * *